US007703943B2

(12) United States Patent
Li et al.

(10) Patent No.: US 7,703,943 B2
(45) Date of Patent: Apr. 27, 2010

(54) COLOR TUNABLE LIGHT SOURCE

(75) Inventors: Yi-Qun Li, Danville, CA (US); Yi Dong, Tracy, CA (US); Xiaofeng Xu, Fremont, CA (US); Ian Collier, Goldhanger (GB)

(73) Assignee: Intematix Corporation, Fremont, CA (US)

( * ) Notice: Subject to any disclaimer, the term of this patent is extended or adjusted under 35 U.S.C. 154(b) by 47 days.

(21) Appl. No.: 11/800,976

(22) Filed: May 7, 2007

(65) Prior Publication Data

US 2008/0278927 A1 Nov. 13, 2008

(51) Int. Cl.
*F21V 9/00* (2006.01)

(52) U.S. Cl. ..... 362/231; 362/235; 359/237

(58) Field of Classification Search ..... 362/612, 362/613, 631, 561, 800, 227, 230, 231, 235, 362/317, 321, 318; 385/129, 130; 359/237, 359/298, 315, 319

See application file for complete search history.

(56) References Cited

U.S. PATENT DOCUMENTS

| | | | | |
|---|---|---|---|---|
| 6,271,825 | B1 | 8/2001 | Greene et al. | |
| 7,014,336 | B1 | 3/2006 | Ducharme et al. | |
| 7,123,796 | B2 * | 10/2006 | Steckl et al. | 385/40 |
| 2004/0203312 | A1 | 10/2004 | Bortscheller et al. | |
| 2005/0152146 | A1 * | 7/2005 | Owen et al. | 362/294 |
| 2005/0270775 | A1 | 12/2005 | Harbers et al. | |
| 2005/0276053 | A1 * | 12/2005 | Nortrup et al. | 362/294 |
| 2006/0177098 | A1 | 8/2006 | Stam | |
| 2006/0198128 | A1 * | 9/2006 | Piepgras et al. | 362/147 |
| 2006/0239006 | A1 | 10/2006 | Chaves et al. | |
| 2007/0031097 | A1 * | 2/2007 | Heikenfeld et al. | 385/129 |
| 2007/0086184 | A1 | 4/2007 | Pugh et al. | |

OTHER PUBLICATIONS

International Search Report and Written Opinion dated Aug. 11, 2008 for International PCT Application No. PCT/US08/62648, 13 pages.

* cited by examiner

*Primary Examiner*—Jacob Y Choi
(74) *Attorney, Agent, or Firm*—Fliesler Meyer LLP

(57) ABSTRACT

A color tunable light source comprises: a first light emitting diode (LED) arrangement operable to emit light of a first color and a second LED arrangement operable to emit light of a second color, the combined light output comprising the output of the source. One or both LED arrangements comprises a phosphor provided remote to an associated LED operable to generate excitation energy of a selected wavelength range and to irradiate the phosphor such that it emits light of a different color wherein light emitted by the LED arrangement comprises the combined light from the LED and phosphor and control means operable to control the color by controlling the relative light outputs of the two LED arrangements. The color can be controlled by controlling the relative magnitude of the drive currents of the LEDs or by controlling a duty cycle of PWM drive current.

3 Claims, 9 Drawing Sheets

COLOR TUNABLE LIGHT SOURCE

BACKGROUND OF THE INVENTION

1. Field of the Invention

This invention relates to a color tunable light source and in particular to a light source based on a light emitting diode (LED) arrangement. Moreover the invention provides a method of generating light of a selected color.

2. Description of the Related Art

Currently, the color of light generated by a light source, in particular light emitting diodes (LEDs), is determined by the physical mechanism used to generate the light. For example, many LEDs incorporate one or more phosphor materials, that is photo luminescent materials, which absorb a portion of the radiation emitted by the LED chip/die and re-emit radiation of a different color (wavelength). The color of light generated by such LEDs is the combined light from the LED chip and Phosphor which is fixed and determined when the LED is fabricated.

It is also known to use a color filter with incandescent, fluorescent and other light sources to generate a selected color of light. To change the color of light requires replacement of the filter.

Color switchable light sources are known which comprise red, green and blue LEDs. The color of light output from such a source can be controlled by selective activation of one or more of the different colored LEDs. For example activation of the blue and red LEDs will generate light which appears purple in color and activation of all three LEDs produces light which appears white in color. A disadvantage of such light sources is the complexity of driver circuitry required to operate these sources.

U.S. Pat. No. 7,014,336 discloses systems and methods of generating colored light. One lighting fixture comprises an array of component illumination sources, different color LEDs, and a processor for controlling the collection of component illumination sources. The processor controls the intensity of the different color LEDs in the array to produce illumination of a selected color within a range bounded by the spectra of the individual LEDs and any filters or other spectrum-altering devices associated with the lighting fixture.

The present invention arose in an endeavor to provide a colored light source whose color is at least in part tunable.

SUMMARY OF THE INVENTION

According to the invention a color tunable light source comprises: a first light emitting diode (LED) arrangement operable to emit light of a first color and a second light emitting diode (LED) arrangement operable to emit light of a second color, the light emitting diode arrangements being configured such that their combined light output comprises the output of the source; characterized in that the first LED arrangement comprises a phosphor provided remote to an associated first LED operable to generate excitation energy of a selected wavelength range and to irradiate the phosphor such that it emits light of a different color wherein light emitted by the first LED arrangement comprises the combined light from the first LED and the light emitted from the phosphor and control means operable to control the color by controlling the relative light outputs of the two light emitting diode arrangements. In the context of this patent application "remote" means that the phosphor is not incorporated within the LED package during fabrication of the LED. Providing the phosphor remote to the LED generating the excitation energy can improve color uniformity and color saturation of the generated light and enables the same excitation source to be used to generate different colors of light by selection of an appropriate phosphor.

In one arrangement the second light emitting diode arrangement also comprises a respective phosphor provided remote to an associated second LED operable to generate excitation energy of a selected wavelength range and to irradiate the phosphor such that it emits light of a different color, wherein the light emitted by the second LED arrangement comprises the combined light from the second LED and the light emitted from the phosphor and wherein the control means is operable to control the color by controlling the relative irradiation of the phosphors. By selecting phosphors which are excited by the same wavelength of excitation energy enables a single type of LED to be used in both LED arrangements. Such an arrangement simplifies the control of the relative light outputs of the LED arrangements since the first and second LEDs have substantially similar opto-electrical characteristics.

The color can be tuned by controlling the relative magnitudes of the drive currents of the LEDs using for example a potential divider arrangement. Alternatively, the drive currents of the LEDs can be switched dynamically and the color tuned by controlling a duty cycle of the drive current to control the relative proportion of time each LED emits light. In such an arrangement the controls means can comprise a pulse width modulated (PWM) power supply that is operable to generate a PWM drive current whose duty cycle is used to select a desired color. Preferably, the LEDs are driven on opposite phases of the PWM drive current. A particular advantage of the invention resides in the use of only two LED arrangements since this enables the color to be tuned by relative control of the drive currents which can be readily implemented using relatively simple and inexpensive drive circuitry.

In a further arrangement the phosphors share a common LED to provide excitation energy for the two phosphors and a respective light controller, such as a liquid crystal shutter, is associated with each phosphor. In such an arrangement the control means is operable to select the color by controlling the light controller to control the relative irradiation of the phosphors rather than controlling the LED drive current. In one such arrangement, the control means is operable to select the color by controlling the relative drive voltages of the respective light controllers to control the intensity of the excitation energy reaching its associated phosphor. Alternatively, the control means can be operable to dynamically switch the drive voltage of the light controllers and wherein the color is tunable by controlling a duty cycle of the voltage. Preferably, the control means comprises a pulse width modulated power supply operable to generate a pulse width modulated drive voltage.

In any arrangement of the invention and to increase the intensity of the light output, the light source can comprise a plurality of first and second LED arrangements that are advantageously configured in the form of an array, for example a square array, to improve color uniformity of the output light.

According to the invention a method of generating light with a selected color comprises: providing a first light emitting diode arrangement and operating it to emit light of a first color and providing a second light emitting diode arrangement and operating it to emit light of a second color; the method being characterized by the first LED arrangement comprising a phosphor provided remote to an associated first LED operable to generate excitation energy of a selected wavelength range and to irradiate the phosphor such that it emits light of a different color wherein light emitted by the first LED arrangement comprises the combined light from the first LED and the light emitted from the phosphor and controlling color of generated light by controlling the relative light outputs of the two LED arrangements.

As with the light source in accordance with the invention, the second LED arrangement can also comprise a respective phosphor provided remote to an associated second LED operable to generate excitation energy of a selected wavelength range and to irradiate the phosphor such that each emits light of a color, wherein the light emitted by the second LED arrangement comprises the combined light from the second LED and the light emitted from the phosphor and comprising selecting a color by controlling relative irradiation of the phosphors.

The method further comprises selecting a color by controlling the relative magnitude of the drive currents of the respective LEDs or dynamically switching the drive currents and selecting the color by controlling a duty cycle of a PWM drive current.

According to the invention the second LED arrangement can comprise a respective phosphor provided remote to the first LED and wherein the first LED is operable to generate excitation energy for the two phosphors and further comprising providing a respective light controller, liquid crystal shutter, associated with each phosphor and controlling the color by controlling the light controllers to control the relative irradiation of the phosphors. The color can be controlled by controlling the relative drive voltages of the respective light controllers or dynamically switching the drive voltage of the light controllers and controlling the color by controlling a duty cycle of the voltage. In one embodiment the method comprises generating a pulse width modulated drive voltage and operating the respective light controllers on opposite phases of the drive voltage.

In one embodiment a color tunable light source comprises: a first light emitting diode LED arrangement operable to emit light of a first color and a second light emitting diode LED arrangement operable to emit light of a second color, the light emitting diode arrangements being configured such that their combined light output comprises the output of the source; characterized in that the first LED arrangement comprises a phosphor provided remote to an associated first blue/UV LED operable to generate excitation energy of a selected wavelength range and to irradiate the phosphor such that it emits light of a different color wherein light emitted by the first LED arrangement comprises the combined light from the first LED and the light emitted from the phosphor and wherein the second light emitting diode arrangement comprises a respective phosphor provided remote to an associated second blue/UV LED operable to generate excitation energy of a selected wavelength range and to irradiate the phosphor such that it emits light of a different color, wherein the light emitted by the second LED arrangement comprises the combined light from the second LED and the light emitted from the phosphor and wherein the control means is operable to control the color by controlling the relative irradiation of the phosphors.

BRIEF DESCRIPTION OF THE DRAWINGS

In order that the present invention is better understood embodiments of the invention will now be described, by way of example only, with reference to the accompanying drawings in which.

DETAILED DESCRIPTION OF THE INVENTION

Figure 1A:
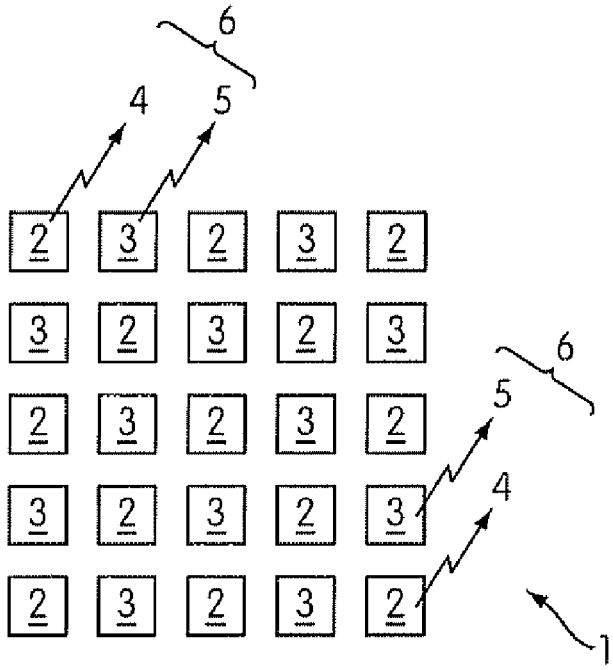
FIGS. 1(*a*) and 1(*b*) are schematic representations of a color tunable light source in accordance with the invention.
Figure 1B:
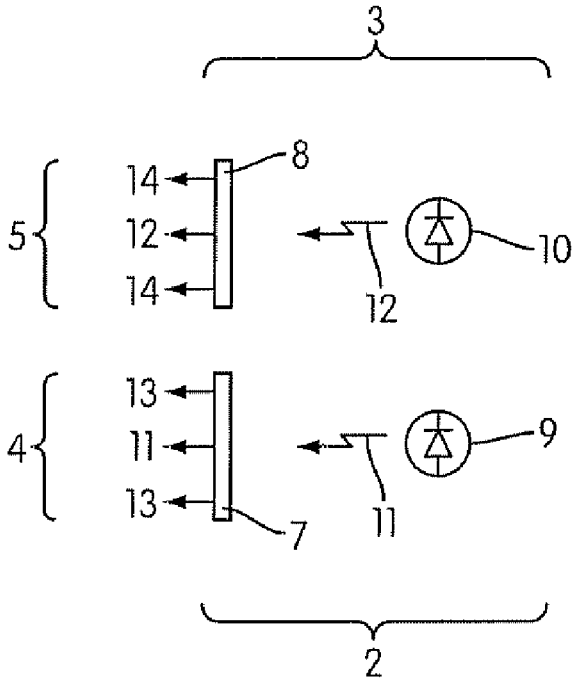

Referring to FIG. 1(*a*) there is shown a schematic representation of a color tunable (selectable) light source 1 in accordance with the invention that comprises an array of first light emitting diode (LED) arrangements 2 and second LED arrangements 3. In the example the array comprises a regular square array of twenty five LED arrangements with thirteen first and twelve second LED arrangements. It will be appreciated that the invention is not limited to a particular number of LED arrangements or a particular geometric layout.

Each of the first LED arrangements 2 is operable to emit light of a first color (wavelength range) and each of the second LED arrangements 3 is operable to emit light of a second color (wavelength range). In the context of this patent application light is defined as electromagnetic radiation in the visible part of the spectrum that is 400 to 750 nm. The combined light 4 and 5 emitted by the LED arrangements 2, 3 comprises the light output 6 of the source 1. As is now described the color of the output light 6 depends on the relative proportion of light contributions from the first and second LED arrangements.

Referring to FIG. 1(*b*), each of the LED arrangements 2, 3 comprises a region of phosphor material 7, 8 which is provided remote to an associated LED 9, 10. The LEDs 9, are operable to generate excitation energy 11, 12 of a selected wavelength range and to irradiate the phosphor such that it emits light 13, 14 of a different wavelength range and the arrangement configured such that light 4, 5 emitted by the LED arrangement comprises the combined light 11, 12 from the LED and the light 13, 14 emitted from the phosphor. In the context of this patent application light emitting diode (LED) is to be construed as meaning any solid-state light source and can include for example laser diodes. Typically the LEDs 9, 10 comprises a blue (400-460 nm)/soft UV (380 nm) LED and the phosphor region 7, 8 a phosphor material or a mixture of colored phosphors to ensure a selected range of light output colors.

Figure 2:
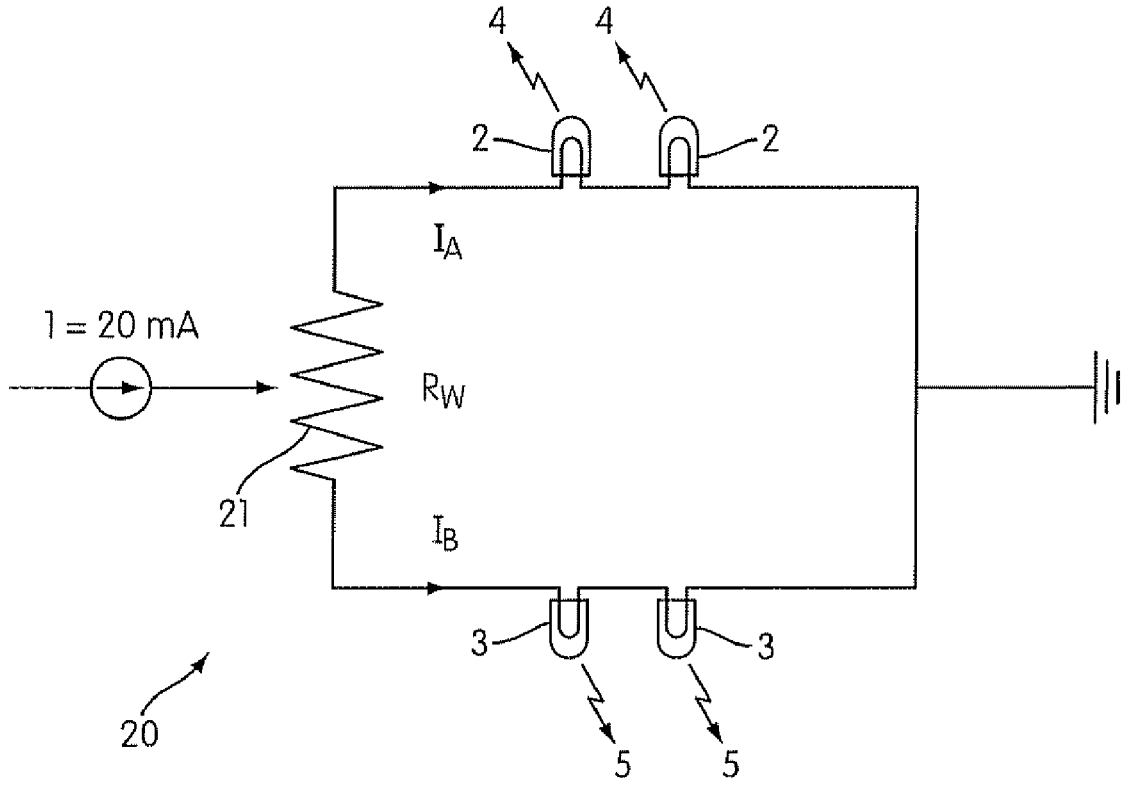
FIG. 2 is a driver circuit for operating the light source of FIG. 1.

Referring to FIG. 2 there is shown a schematic representation of a driver circuit 20 for operating the light source 1 of FIG. 1. The driver circuit 20 comprises a variable resistor 21 $R_w$ for controlling the relative drive currents $I_A$ and $I_B$ to the first and second LED arrangements 2, 3. The LEDs 9, 10 of each LED arrangement 2, 3 are connected in series and the LED arrangements connected in parallel to the variable resistor 21. The variable resistor 21 is configured as a potential divider and is used to select the relative drive currents $I_A$ and $I_B$ to achieve a selected color of output light.

Figure 3:
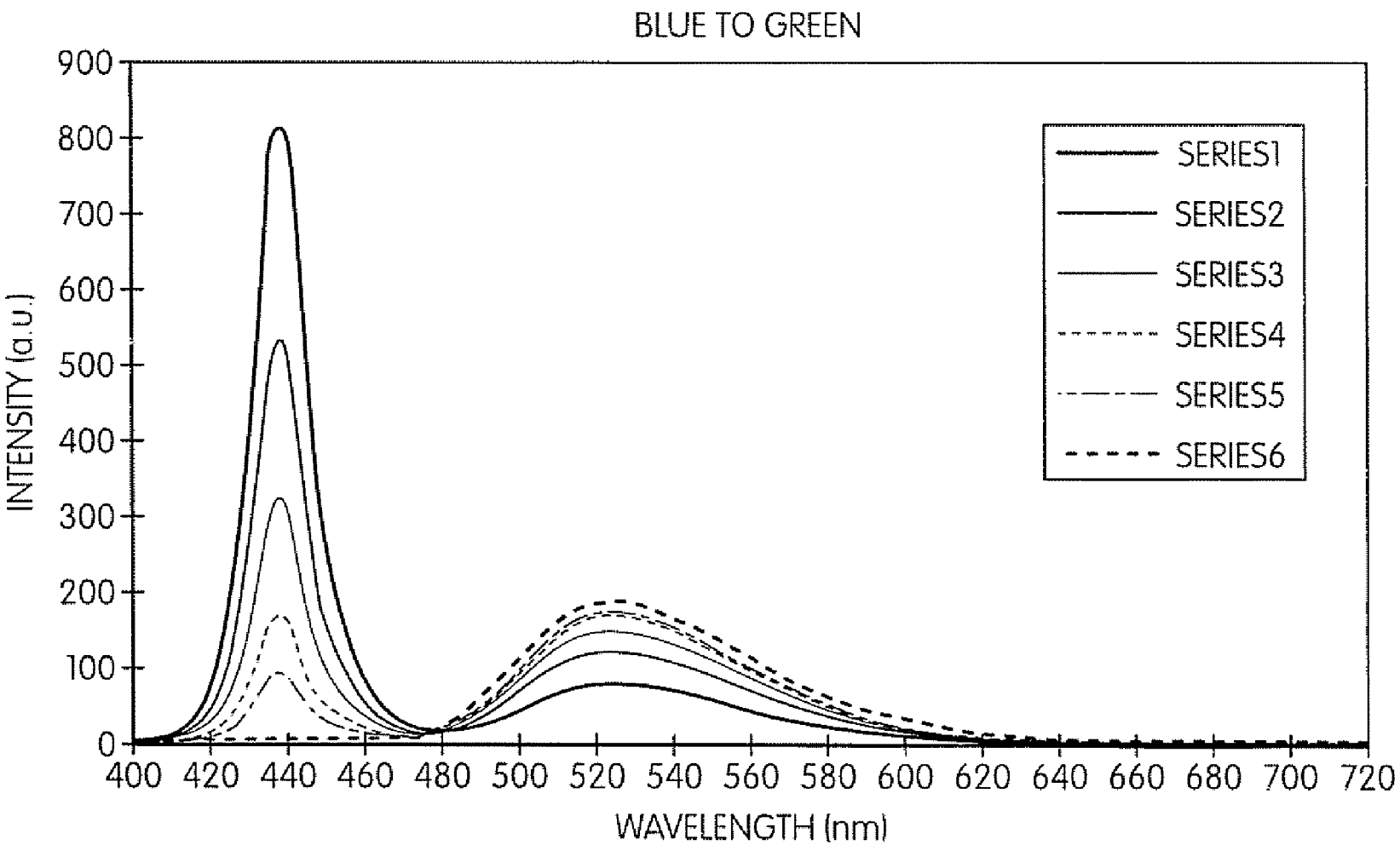
FIG. 3 is a plot of output light intensity versus wavelength for selected colors for the source of FIG. 1 having blue and green LED arrangements.

FIG. 3 is a plot of output light intensity (arbitrary units) versus wavelength (nm) for the light source of FIG. 1 for selected colors in which the first LED arrangement 2 emits blue light (400-460 nm) and the second LED arrangement 3 emits green light (525 nm). In such an arrangement the first LED arrangement 2 can comprise a blue (450 nm) LED 9 and there is no need to include an associated phosphor and the second LED arrangement a blue LED 10 and a blue activated green light emitting phosphor 8. The different colored light is generated by changing the relative magnitude of the drive current $I_A$ and $I_B$ Table 1 tabulates chromaticity coordinates CIE (x, y) for selected colors/drive current ratios. As will be appreciated when $I_A$ is very much larger than $I_B$ light generated by the source originates predominantly from the first LED arrangement and will be blue in color. Conversely if $I_B$ is much greater than $I_A$ light generated by the source originates predominantly from the second LED arrangement and will be green in color. For relative drive currents in between the light output comprises contributions from the first and second LED arrangements and will have a color in between blue and green, that is blue/green.

TABLE 1

Chromaticity coordinates CIE (x, y) for selected colors for a light source having blue and green LED arrangements

| Series # | $I_A$(%):$I_B$(%) | CIE (x) | CIE (y) | Color |
|---|---|---|---|---|
| 1 | 46.0:54.0 | 0.185 | 0.138 | Blue |
| 2 | 26.6:73.4 | 0.206 | 0.242 | |
| 3 | 14.9:85.1 | 0.228 | 0.348 | ↓ |
| 4 | 7.2:92.8 | 0.250 | 0.457 | |
| 5 | 3.9:96.1 | 0.265 | 0.531 | |
| 6 | 0.0:100 | 0.286 | 0.634 | Green |

Figure 4:
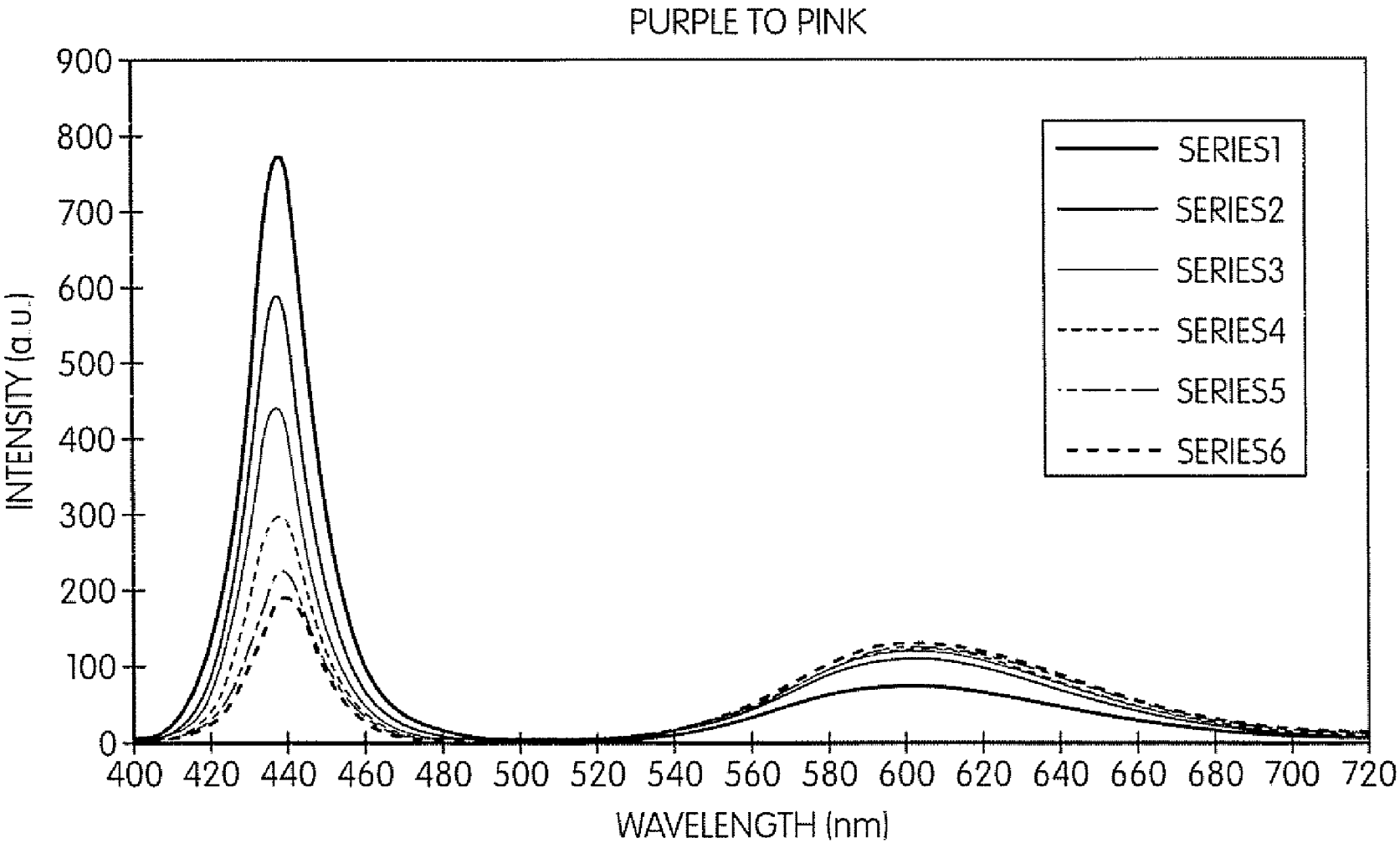
FIG. 4 is a plot of output light intensity versus wavelength for selected colors for the source of FIG. 1 having purple and pink LED arrangements.

FIG. 4 is a plot of output light intensity (arbitrary units) versus wavelength (nm) for the light source of FIG. 1 for selected colors in which the first LED arrangement 2 emits purple light and the second LED arrangement 3 emits pink light. In this arrangement the LED arrangements 2, 3 each comprise a blue (450 nm) LED 9, 10 and blue activated red light (625 nm) emitting phosphor 7, 8 with a higher proportion of red phosphor being provided in the second LED arrangement. Table 2 tabulates chromaticity coordinates CIE (x, y) for selected colors/drive current ratios. As will be appreciated when $I_A$ is very much larger than $I_B$ light generated by the source originates predominantly from the first LED arrangement and will be purple in color. Conversely if $I_B$ is much greater that $I_A$ light generated by the source originates predominantly from the second LED arrangement and will be pink in color. For relative drive currents in between the light output comprises contributions from the first and second LED arrangements and will have a color in between purple and pink.

TABLE 2

Chromaticity coordinates CIE (x, y) for selected colors for a light source having purple and pink LED arrangements

| Series # | $I_A$(%):$I_B$(%) | CIE (x) | CIE (y) | Color |
|---|---|---|---|---|
| 1 | 100.0:0.0 | 0.243 | 0.110 | Purple |
| 2 | 82.5:17.5 | 0.300 | 0.160 | |
| 3 | 63.1:36.9 | 0.341 | 0.197 | ↓ |
| 4 | 42.3:57.7 | 0.379 | 0.233 | |
| 5 | 28.9:71.1 | 0.400 | 0.256 | |
| 6 | 0.0:100.0 | 0.416 | 0.271 | Pink |

Figure 5:
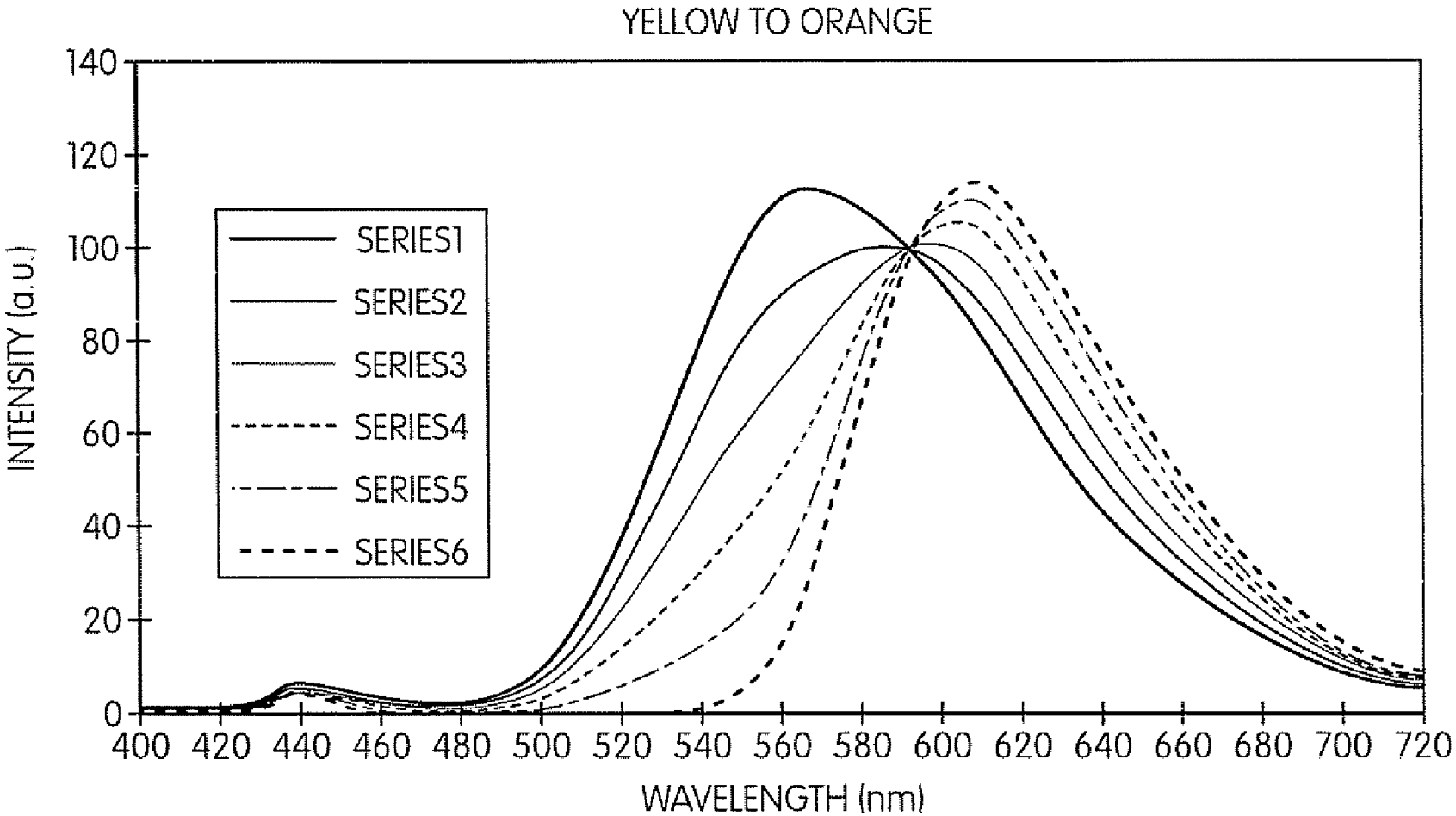
FIG. 5 is a plot of output light intensity versus wavelength for selected colors for the source of FIG. 1 having yellow and orange LED arrangements.

FIG. 5 is a plot of output light intensity (arbitrary units) versus wavelength (nm) for the light source of FIG. 1 for selected colors in which the first LED arrangement 2 emits yellow light (570-580 nm) and the second LED arrangement 3 emits orange light (595-600 nm). In this arrangement the first LED arrangement 2 comprises a blue LED 9 and blue activated yellow light emitting phosphor 7 and the second LED arrangement 3 comprises a blue LED 10 and blue activated orange light emitting phosphor 8. Table 3 tabulates chromaticity coordinates CIE (x, y) for selected colors/drive current ratios. As will be appreciated when $I_A$ is very much larger than $I_B$ light generated by the source originates predominantly from the first LED arrangement and will be yellow in color. Conversely if $I_B$ is much greater that $I_A$ light generated by the source originates predominantly from the second LED arrangement and will be orange in color. For relative drive currents in between the light output comprises contributions from the first and second LED arrangements and will have a color in between yellow and orange.

TABLE 1

Chromaticity coordinates CIE (x, y) for selected colors for a light source having yellow and orange LED arrangements

| Series # | $I_A$(%):$I_B$(%) | CIE (x) | CIE (y) | Color |
|---|---|---|---|---|
| 1 | 100.0:0.0 | 0.465 | 0.519 | Yellow |
| 2 | 52.8:47.2 | 0.486 | 0.500 | |
| 3 | 31.5:68.5 | 0.510 | 0.478 | ↓ |
| 4 | 14.9:85.1 | 0.540 | 0.450 | |
| 5 | 5.0:95.0 | 0.570 | 0.422 | |
| 6 | 0.0:100.0 | 0.601 | 0.392 | Orange |

Figure 6:
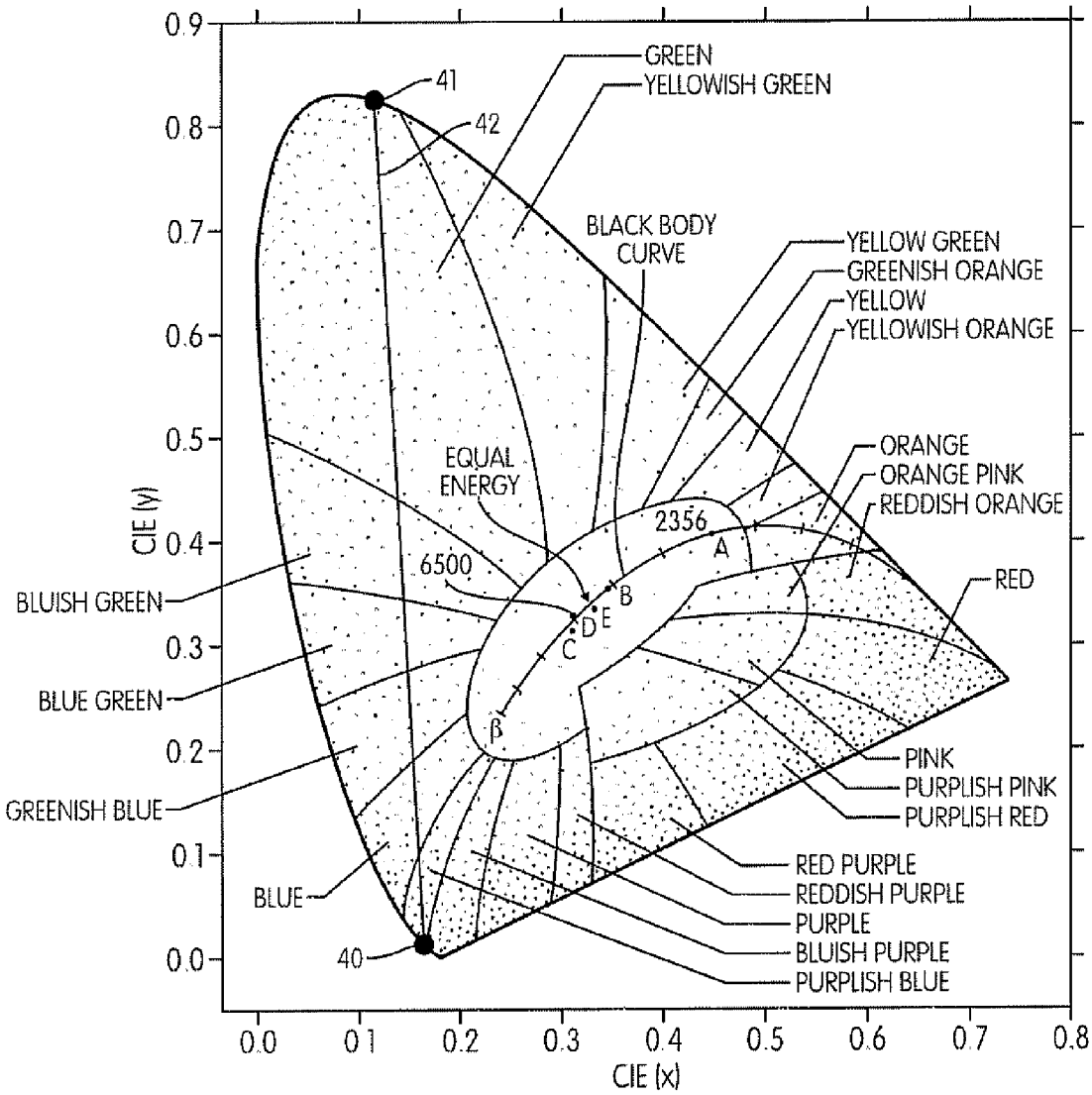
FIG. 6 is a CIE xy chromaticity diagram indicating chromaticity coordinates for various phosphors.

FIG. 6 is a CIE 1931 xy chromaticity diagram. A line 42 connecting two points 40, 41 represents an example of the possible colors of output light the source can generate by changing the magnitude of the drive currents $I_A$ and $I_B$. The example illustrated is for a first LED arrangement which emits blue light 40 (450 nm) and a second LED arrangement which emits green light.

Figure 7:
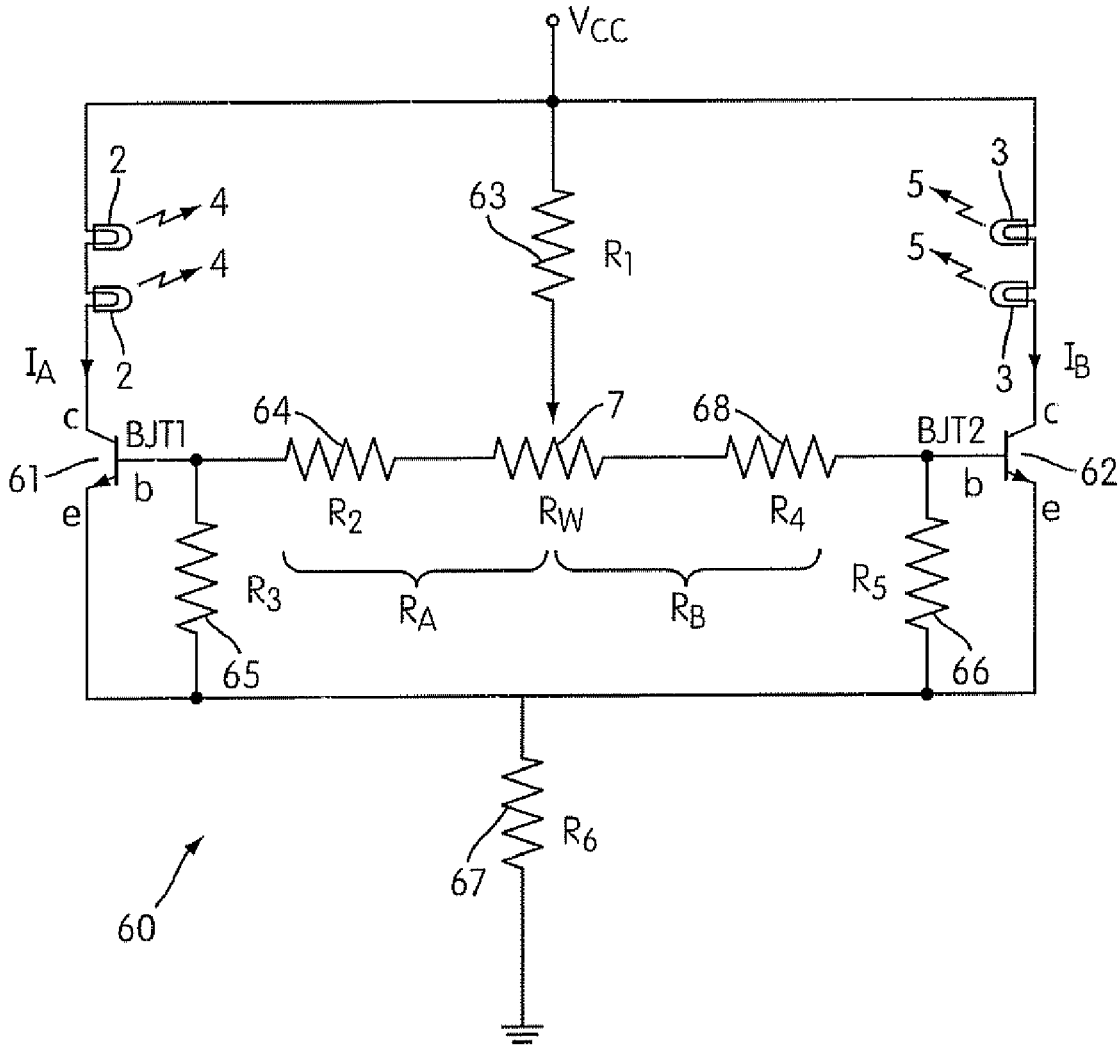
FIG. 7 is a further driver circuit for operating the light source of FIG. 1.

FIG. 7 shows a further driver circuit 60 for operating the light source of FIG. 1. The driver circuit 60 comprises a respective bipolar junction transistor BJT1, BJT2 (61, 62) for operating each LED arrangement 2, 3 and a bias network comprising resistors $R_1$ to $R_6$, denoted 63 to 67, for setting the dc operating conditions of the transistors 61, 62. The transistors 61, 62 are configured as electronic switches in a grounded-emitter e configuration. The first and second LED arrangements are serially connected between a power supply $V_{CC}$ and the collector terminal c of their respective transistor. The variable resistor $R_W$ 7 is connected between the base terminals b of the transistors and is used to set the relative drive currents $I_A$ and $I_B$ (where $I_A$=$I_{ce}$ of BJT1 and $I_B$=$I_{ce}$ of BJT2) of the first and second LED arrangements 2, 3 and hence color of the source by setting the relative voltage $V_{b1}$ and $V_{b2}$ at the base of the transistor. The control voltages $V_{b1}$ and $V_{b2}$ are given by the relationships:

$$V_{b1} = \left[\frac{R_A + R_1}{R_A + R_1 + R_3 + R_6}\right]V_{CC} \text{ and } V_{b2} = \left[\frac{R_B + R_1}{R_B + R_1 + R_5 + R_6}\right]V_{CC}.$$

Figure 8:
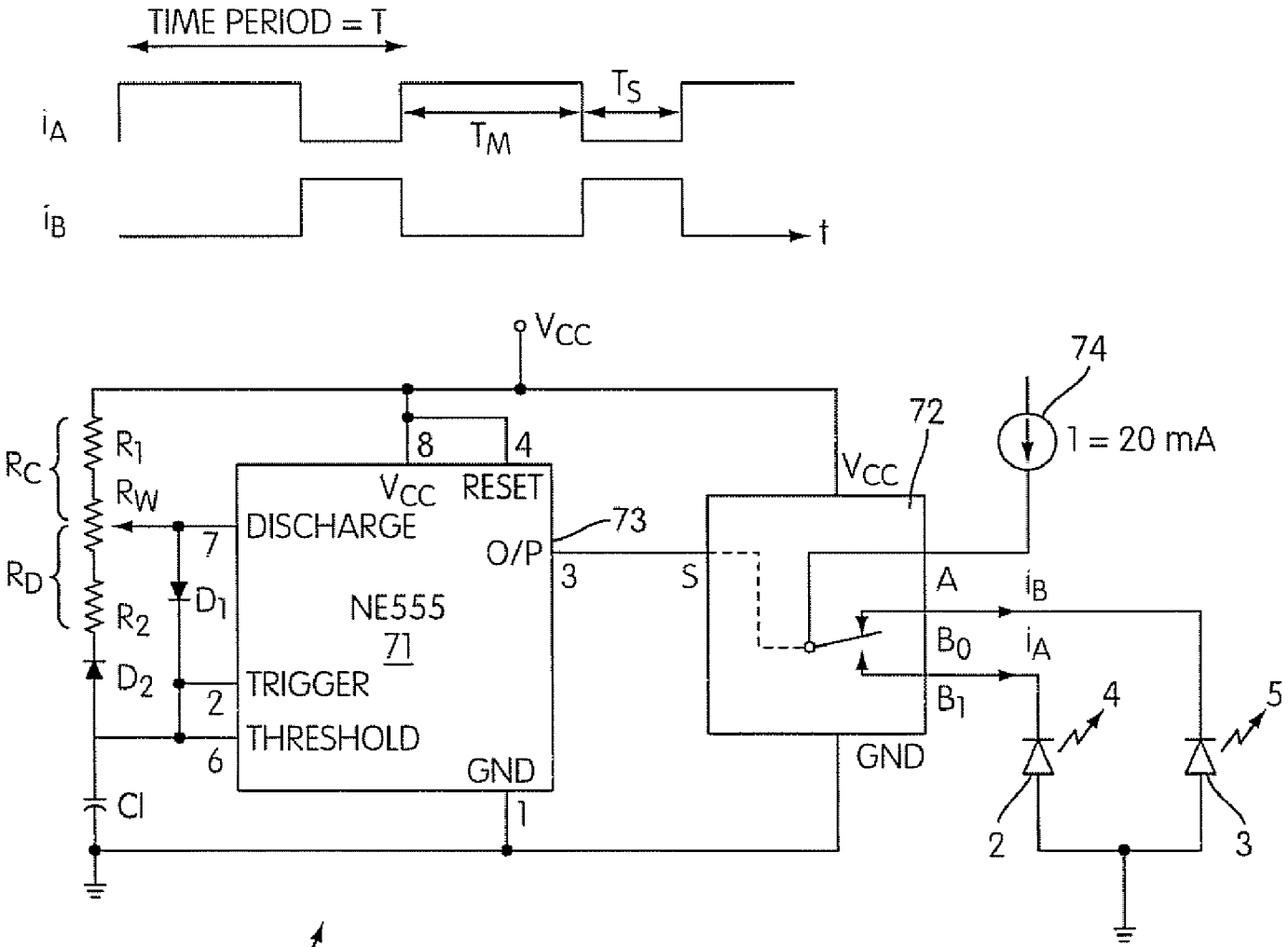
FIG. 8 is a pulse width modulated driver circuit for operating the light source of FIG. 1.

As an alternative to driving the LED arrangements with a dc drive current $I_A$, $I_B$ and setting the relative magnitudes of the drive currents to set the color, the LED arrangements can be driven dynamically with a pulse width modulated (PWM) drive current $i_A$, $i_B$. FIG. 8 illustrates a PWM driver circuit 70 operable to drive the two LED arrangements 2, 3 on opposite phases of the PWM drive current (that is $i_B=\overline{i_A}$). The duty cycle of the PWM drive current is the proportion of a complete cycle (time period T) for which the output is high (mark time $T_m$) and determines how long within the time period the first LED arrangement is operable. Conversely, the proportion of time of a complete time period for which the output is low (space time $T_s$) determines the length of time the second LED arrangement is operable. An advantage of driving the LED arrangements dynamically is that each is operated at an optimum drive current though the time period needs to be selected to prevent flickering of the light output and to ensure light emitted by the two LED arrangements when viewed by an observer combine to give light which appears uniform in color.

The driver circuit 70 comprises a timer circuit 71, for example an NE555, configured in an astable (free-run) operation whose duty cycle is set by a potential divider arrangement comprising resistors $R_1$, $R_W$, $R_2$ and capacitor C1 and a low voltage single-pole/double throw (SPDT) analog switch 72, for example a Fairchild Semiconductor™ FSA3157. The output of the timer 73, which comprises a PWM drive voltage, is used to control operation of the SPDT analog switch 72. A current source 74 is connected to the pole A of the switch and the LED arrangements 2, 3 connected between a respective output $B_0$ $B_1$ of the switch and ground. In general the mark time $T_m$ is greater than the space time $T_s$ and consequently the duty cycle is less than 50% and is given by:

$$\text{Duty cycle (without signal diode } D_1) = \frac{T_m}{T_m + T_s} = \frac{R_C + R_D}{R_D + 2R_D}$$

where $$T_m = 0.7(R_C + R_D)C1,\ T_s = 0.7R_C C1 \text{ and } T = 0.7(R_C + 2R_D)C1.$$

To obtain a duty cycle of less than 50% a signal diode D1 can be added in parallel with the resistance $R_D$ to bypass $R_D$ during a charging (mark) part of the timer cycle. In such a configuration the mark time depends only on $R_C$ and C1 ($T_m$=0.7 $R_C$ C1) such that the duty cycle is given:

$$\text{Duty cycle (with signal diode } D_1) = \frac{T_m}{T_m + T_s} = \frac{R_C}{R_C + R_D}.$$

Figure 9:
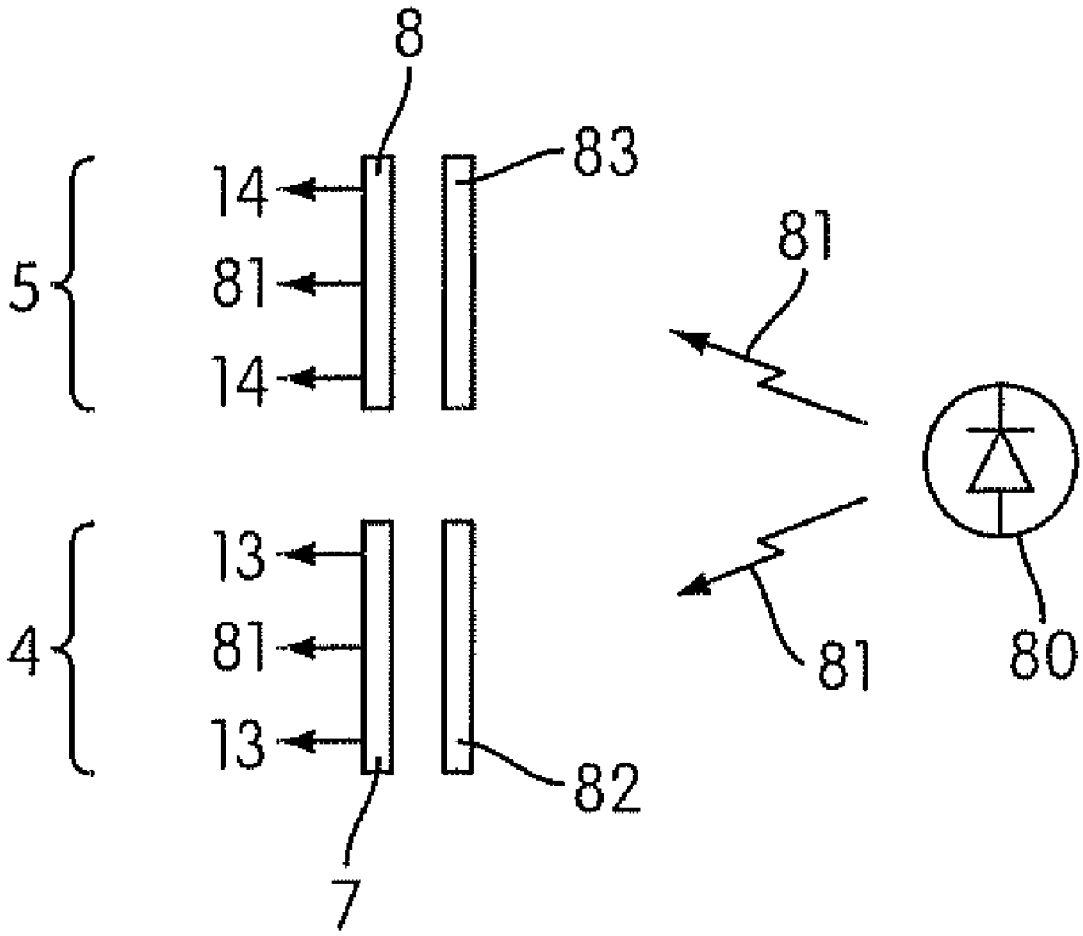
FIG. 9 is a schematic representation of a further color tunable light source in accordance with the invention.

It will be appreciated by those skilled in the art that modifications can be made to the light source disclosed without departing from the scope of the invention. For example, whilst in exemplary implementations each LED arrangement is described as comprising a phosphor provided as a respective area remote to a respective LED die, in other embodiments, as shown in FIG. 9, it is envisaged to use one LED 80 to irradiate the two different phosphors 7, 8 with excitation energy 81. In such an arrangement the color of the source cannot be controlled by controlling the drive current of the LED and a respective light controller 82, 83 is provided to control the relative light output from each LED arrangement. In one implementation the light controller 82, 83 comprises a respective LCD shutter and the LCD shutters can be controlled using the driver circuits described to control the drive voltage of the shutters. Moreover, the LCD shutters are advantageously fabricated as an array and the phosphor provided as a respective region on a surface of and overlaying a respective one of LCD shutter of the array.

Moreover, in exemplary implementations the LED arrangements are described as comprising a respective LED and associated one or more phosphors to achieve a selected color of emitted light, in other embodiments the phosphor can be provided remote to a respective LED as a respective area. In such an arrangement the LED is operable to generate excitation radiation, typically blue or UV light, and to irradiate the phosphor such that the phosphor emits light of a different wavelength range. Providing not all of the excitation energy is absorbed by the phosphor the light emitted by each LED arrangement will comprise the combined light emitted by the LED and the phosphor.

The color tunable light source of the invention finds particular application in lighting arrangements for commercial and domestic lighting applications such as for example architectural accent lighting. Since the color is tunable the source of the invention is particularly advantageous when used in signage applications where the change in color can be used to attract attention.

What is claimed is:

1. A color tunable light source comprising:

a first light emitting diode arrangement operable to emit light of a first color;

a second light emitting diode arrangement operable to emit light of a second color, the light emitting diode arrangements being configured such that their combined light output comprises the output of the source, wherein the first light emitting diode arrangement comprises a phosphor provided remote to an associated first light emitting diode that is operable to generate excitation light of a selected wavelength range and to irradiate the phosphor such that the phosphor emits light of a different color, wherein light emitted by the first light emitting diode arrangement comprises the combined light from the first light emitting diode and the light emitted from the phosphor; and control means operable to control the color of light emitted by the source by controlling the ratio of intensity of light emitted by the first and second light emitting diode arrangements, the control means comprising a pulse width modulated power supply operable to generate a pulse width modulated drive current and wherein the first and second light emitting diode arrangements are operable on opposite phases of the pulse width modulated drive current and the color of light emitted by the source is controllable by a duty cycle of the drive current.

2. A color tunable light source comprising:

a first light emitting diode arrangement operable to emit light of a first color;

a second light emitting diode arrangement operable to emit light of a second color, the light emitting diode arrangements being configured such that their combined light output comprises the output of the source, wherein the light emitting diode arrangements comprise a respective phosphor provided remote to a light emitting diode that is operable to generate excitation light of a selected wavelength range and to irradiate the phosphors such that each emits light of a different color and wherein light emitted by each light emitting diode arrangement comprises the combined light from the light emitting diode and the light emitted from the phosphor; a light controller associated with each phosphor; and control means operable to control the color of light emitted by the source by controlling the light controllers to control the ratio of irradiation intensity of the phosphors, wherein the control means comprises a pulse width modulated power supply operable to generate a pulse width modulated drive voltage and the light controllers are operable on opposite phases of the pulse width modulated drive voltage and the color of light emitted by the source is tunable by controlling a duty cycle of the drive voltage.

3. A color tunable light source comprising:

a first light emitting diode arrangement operable to emit light of a first color and comprising a phosphor provided remote to an associated first blue/UV light emitting diode operable to generate excitation energy of a selected wavelength range and to irradiate the phosphor such that the phosphor emits light of a different color wherein light emitted by the first light emitting diode arrangement comprises the combined light from the first light emitting diode and the light emitted from the phosphor;

a second light emitting diode arrangement operable to emit light of a second color and comprising a respective phosphor provided remote to an associated second blue/UV light emitting diode operable to generate excitation energy of a selected wavelength range and to irradiate the phosphor such that it emits light of a different color wherein the light emitted by the second light emitting diode arrangement comprises the combined light from the second light emitting diode and the light emitted from the phosphor, wherein the light emitting diode arrangements are configured such that their combined light output comprises the output of the source; and control means operable to control the color of light emitted by the source by controlling the ratio of intensity of light emitted by the first and second light emitting diode arrangements, the control means comprising a pulse width modulated power supply operable to generate a pulse width modulated drive current and wherein the first and second light emitting diodes are operable on opposite phases of the pulse width modulated drive current and the color of light emitted by the source is controllable by a duty cycle of the drive current.

* * * * *